US005901949A

United States Patent [19]

Muranaka et al.

[11] Patent Number: 5,901,949

[45] Date of Patent: May 11, 1999

[54] CONVEYOR SYSTEM FOR COLLATING PHOTOGRAPHIC PRINTS AND NEGATIVES

[75] Inventors: Takayoshi Muranaka; Hiroshi Miyawaki; Masanori Nakano; Toshio Doi; Kozo Mano, all of Wakayama, Japan

[73] Assignee: Noritsu Koki Co., Ltd, Wakayama-ken, Japan

[21] Appl. No.: 08/923,365

[22] Filed: Sep. 4, 1997

[30] Foreign Application Priority Data

Sep. 10, 1996 [JP] Japan ..... 8-238822

[51] Int. Cl.[6] ..... B65H 39/06

[52] U.S. Cl. ..... 270/58.23; 270/52.01; 270/58.29; 396/612; 198/343.1; 198/465.1; 198/690.1

[58] Field of Search ..... 270/52.01, 52.1, 270/52.14, 52.16, 58.01, 58.05, 58.14, 58.22, 58.23, 58.29, 58.31; 271/294, 292, 298; 198/343.1, 343.2, 419.1, 459.8, 460.3, 867.11, 867.14, 690.1, 465.1; 396/612; 414/790.44

[56] References Cited

U.S. PATENT DOCUMENTS

| | | | |
|---|---|---|---|
| 3,926,489 | 12/1975 | Futch | 198/803.1 |
| 4,097,147 | 6/1978 | Portewig | 355/106 |
| 4,102,448 | 7/1978 | Wolbrink et al. | 198/370.03 |
| 4,344,727 | 8/1982 | Chaloupka | 198/403 |
| 4,619,452 | 10/1986 | Euteneuer et al. | 271/305 |
| 4,869,361 | 9/1989 | Huang et al. | 271/294 |
| 5,448,335 | 9/1995 | Ishikawa et al. | 271/294 |
| 5,503,264 | 4/1996 | Eberle | 198/803.1 |

FOREIGN PATENT DOCUMENTS

| | | | |
|---|---|---|---|
| 617327 | 9/1994 | European Pat. Off. | G03D 15/00 |
| 722113 | 7/1996 | European Pat. Off. | G03D 15/00 |
| 2267552 | 11/1990 | Japan | 65/31 |

*Primary Examiner*—William E. Terrell
*Assistant Examiner*—Patrick Mackey
*Attorney, Agent, or Firm*—Fulbright & Jaworski, LLP

[57] ABSTRACT

A photograph collating system for combining and collating negative films and prints. The system includes a conveyer mechanism (70) extending through a negative film intake station (71) for receiving the negative films from a negative film outlet (60), a print intake station (73) for receiving the prints from a print outlet (50), and a collating station (74) for collating the negative films and prints.

The conveyer mechanism (70) includes trays (100) for transporting the negative films (2) and the prints (3), a guide circuit (80) defining a transport passage of the trays, and a drive device (90) for moving the trays along the guide circuit (80). Each of the trays having moved to the collating station (74) is disengaged from the drive device by contact with a preceding one of the trays in a direction of transport.

8 Claims, 12 Drawing Sheets

CONVEYOR SYSTEM FOR COLLATING PHOTOGRAPHIC PRINTS AND NEGATIVES

BACKGROUND OF THE INVENTION

1. Field of the Invention

This invention relates to a photograph collating system having a negative film outlet for discharging negative films used to print images on printing paper in an exposing section, and a print outlet for cutting the printing paper printed and developed to predetermined lengths, and discharging the cut printing paper as prints, the negative films discharged and the prints discharged and having the images of the negative films being combined and collated. More particularly, the invention relates to a photograph collating system having a conveyer mechanism extending through a negative film intake station for receiving negative films from the negative film outlet, a print intake station for receiving prints from the print outlet, and a collating station for collating the negative films and the prints.

2. Description of the Related Art

In the photograph collating system noted above, a combination of negative films and prints processed as one unit usually is based on a singe length of negative film or one set of piece negatives (cut negative films each having four or six frames) ordered by a customer. This one unit is called one order also. A photograph collating system for collating piece negatives and prints in one order and automatically putting the negatives and prints in a product packet is known from Japanese Patent Publication Kokai No. H6-43622, for example. This photograph collating system includes separate transport conveyers for transporting piece negatives in one order emerging from a negative film outlet and for transporting prints in one order emerging from a print outlet. A further separate conveyer is provided for transporting a combination of peace negatives and prints in one order to a packing station.

With the plurality of separate and independent transport conveyers for

With the plurality of separate and independent transport conveyers for collation, the entire system not only is large but poses such other problems that these transport conveyers interfere with one another in arrangement and that difficulties are encountered in transferring articles from one conveyer to another.

SUMMARY OF THE INVENTION

The object of this invention is to provide a photograph collating system which overcomes the disadvantages noted above, which has a simplified transport conveyer extending among three stations, i.e. a negative film intake station for receiving negative films from a negative film outlet, a print intake station for receiving prints from a print outlet, and a collating station for collating the negative films and prints, and which facilitates an operation to take out combined and collated negative films and prints.

The above object is fulfilled, according to this invention by a photograph collating system having a negative film outlet for discharging negative films used to print images on printing paper in an exposing section, and a print outlet for cutting the printing paper printed and developed to predetermined lengths, and discharging the cut punting paper as prints, the negative films discharged and the prints discharged and having the images of the negative films being combined and collated, the system comprising a negative film intake station for receiving the negative films from the negative film outlet, a print intake station for receiving the prints from the print outlet, a collating station for collating the negative films and the prints, and a conveyer mechanism extending through the negative film intake station, the print intake station and the collating station, the conveyer mechanism including trays for transporting the negative films and the prints, a guide circuit defining a transport passage of the trays, and drive means for moving the trays along the guide circuit, wherein each of the trays having moved to the collating station is disengaged from the dive means by contact with a preceding one of the trays in a direction of transport.

In the photograph collating system having the above construction, a tray is loaded with negative films in one unit at the negative film intake station, and with prints in the same one unit at the print intake station. When the tray moves to the collating station, the tray becomes disengaged from the drive means moving the tray, through contact with a tray having arrived there earlier. Thus, the trays are stored as standing close to one another. When the preceding tray moves on, the next tray is immediately engaged with the drive means again to move toward the preceding tray. In this way, the trays are stored at the collating station in a constantly packed state in the direction of transport, for allowing the operator to collect the collated negative films and prints with ease. Further, the trays are movable in a tray conveyer mode along the guide circuit through the three stations, i.e. the negative film intake station, print intake station and collating station. This feature provides an increased freedom of arrangement.

It is proposed, in a preferred embodiment of this invention, to divide the drive means into a first drive unit for moving the trays to the collating station, a second drive unit for moving the trays to the negative film intake station, and a third drive unit for moving the trays to the print intake station. The drive means divided into a plurality of drive units is easy to arrange to move the trays along the guide circuit. Where the trays are moved between the respective stations by the individual drive units, optimal movement of the trays, e.g. transport speed and transport cycles, may be selected for each station, to improve the efficiency of transport.

At the collating station, the negative films and prints successively delivered unit by unit are collected from the trays while confirming their collation. Thus, in a preferred embodiment of the invention, the collating station includes a stopper for stopping each of the trays in a predetermined position, thereby forming a storage line for successively storing the trays, with one of the trays stopped by the stopper unit being in a foremost position. The invention employs a tray conveyer mechanism in which the drive means for driving the trays are formed separately from the guide circuit acting as transport rails. With the stopper disposed in a position convenient for collection of the negative films and prints from the trays, the trays successively stand in a packed state from the position of the stopper backward. As an emptied tray moves on from the stopper, the next tray moves to the stopper position. Even if the collating and collecting operation at the collating station takes different periods of time from tray to tray, the trays may be moved smoothly and the collating and collecting operation may be carried out steadily.

In order to absorb a difference between the time taken for the negative films used in the exposing section to reach the negative film outlet and the time taken for the prints printed with the image of the negative films to be developed and delivered to the print outlet, a preferred embodiment of this invention includes a standby station for forming a further storage line between the negative film intake station and the print intake station. Consequently, the negative films and prints to be collated are combined in a well-timed manner at the print intake station. In this embodiment, the first drive unit may include an endless drive element such as a chain or belt. Utilizing the flexibility of its layout, the endless drive unit may be extended to the standby station to form the further storage line of the standby station. Then, the two storage lines of the collating station and standby station having the same transport condition such as transport speed may share a drive motor and its control which contributes to a cost reduction.

A specific arrangement of the storage lines in the tray conveyer mechanism employed in this invention may readily be realized, for example, by the first drive unit being continuously operable in magnetic engagement with the trays. That is, since the first drive unit for driving the trays is formed separately from the guide circuit acting as transport rails, a tensile force will act between the first drive unit and the tray stopped by the stopper. When this tensile force overcomes the magnetism joining the first drive unit and the tray, only the first drive unit moves forward, leaving the tray standing still. When the tray is released from the arresting force, the tray is moved forward again by magnetic engagement with the first drive unit. Such an engagement may be achieved by employing a link structure in which an engaging pin of the tray engaged with the first drive unit is retracted by contact with a preceding tray. However, magnetic engagement is preferable from the viewpoint of simplicity of construction.

In a preferred embodiment of the invention, each of the trays includes a film holder for storing the negative films, and a print holder for storing the prints, the prints having the images of the negative films stored in the film holder being stored in the print holder of the same tray. According to this construction, negative films in one unit is loaded into the film holder of an empty tray having moved to the negative film intake station. The tray loaded with the negative films moves to the print intake station where the prints in the same unit having the images of the negative films are loaded into the print holder. The tray then moves to the collating station. In the collating station, the negative films and print having been transported by the same tray are taken out and combined to complete collation. An ID given to this tray can be associated on one-to-one basis with an ID of each of the negative films and prints in one unit. Thus, collation control is facilitated by using the tray as a medium.

In a preferred embodiment of the invention, each of the trays defines an inclined print holding surface, the trays being forcibly vibrated during transport from the print intake station the collating station. With this construction, the prints loaded without order at the print intake station may be aligned to some extent. The prints are loaded on the tray with edges thereof not completely aligned. This construction utilizes a well-known phenomenon in which articles stacked on an inclined surface are shifted along the surface by the vibration applied, whereby the edges thereof become flush. By applying this phenomenon to the prints transported by the trays, the prints are aligned by the time the trays arrive at the collating station. Such forcible can be achieved by various methods. For example, the guide circuit may include an undulating portion for forcibly vibrating the trays. In this case, no additional power device is required for applying vibration from outside, which provides the advantage of a very simple vibration generating structure. In order to apply optimal vibration, it is of course possible to form a carriage for supporting prints and negative films separately from a running device for running along the guide circuit, with a flexion mechanism connecting the carriage and the running device, and vibrate the carriage with a vibrator.

Other features and the advantages of this invention will be apparent from the following description of the embodiments to be taken with reference to the drawing.

DESCRIPTION OF THE PREFERRED EMBODIMENT

Figure 1:
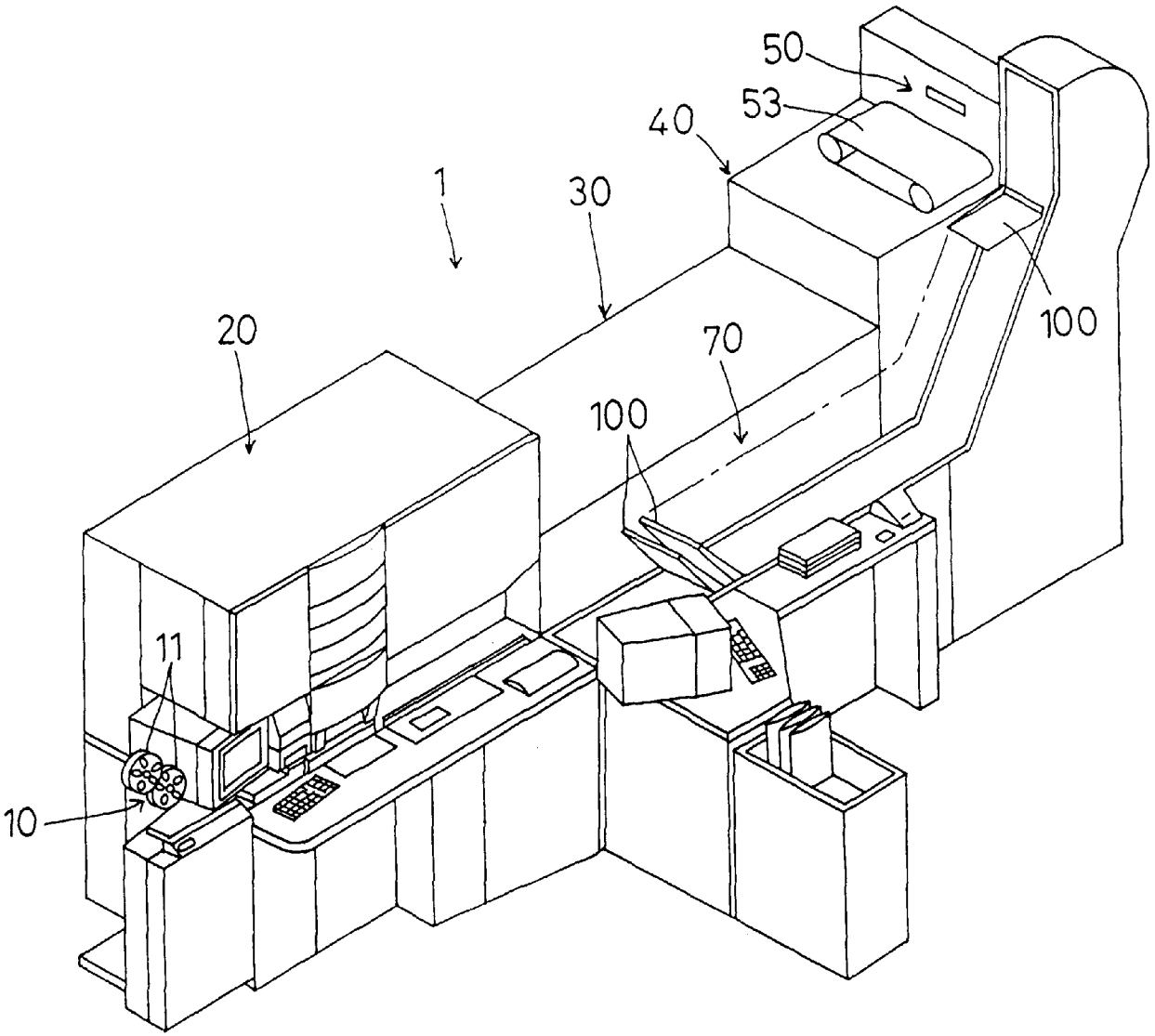
FIG. 1 is a perspective view of a photographic processing apparatus employing a photograph collating system according to this invention.
Figure 2:
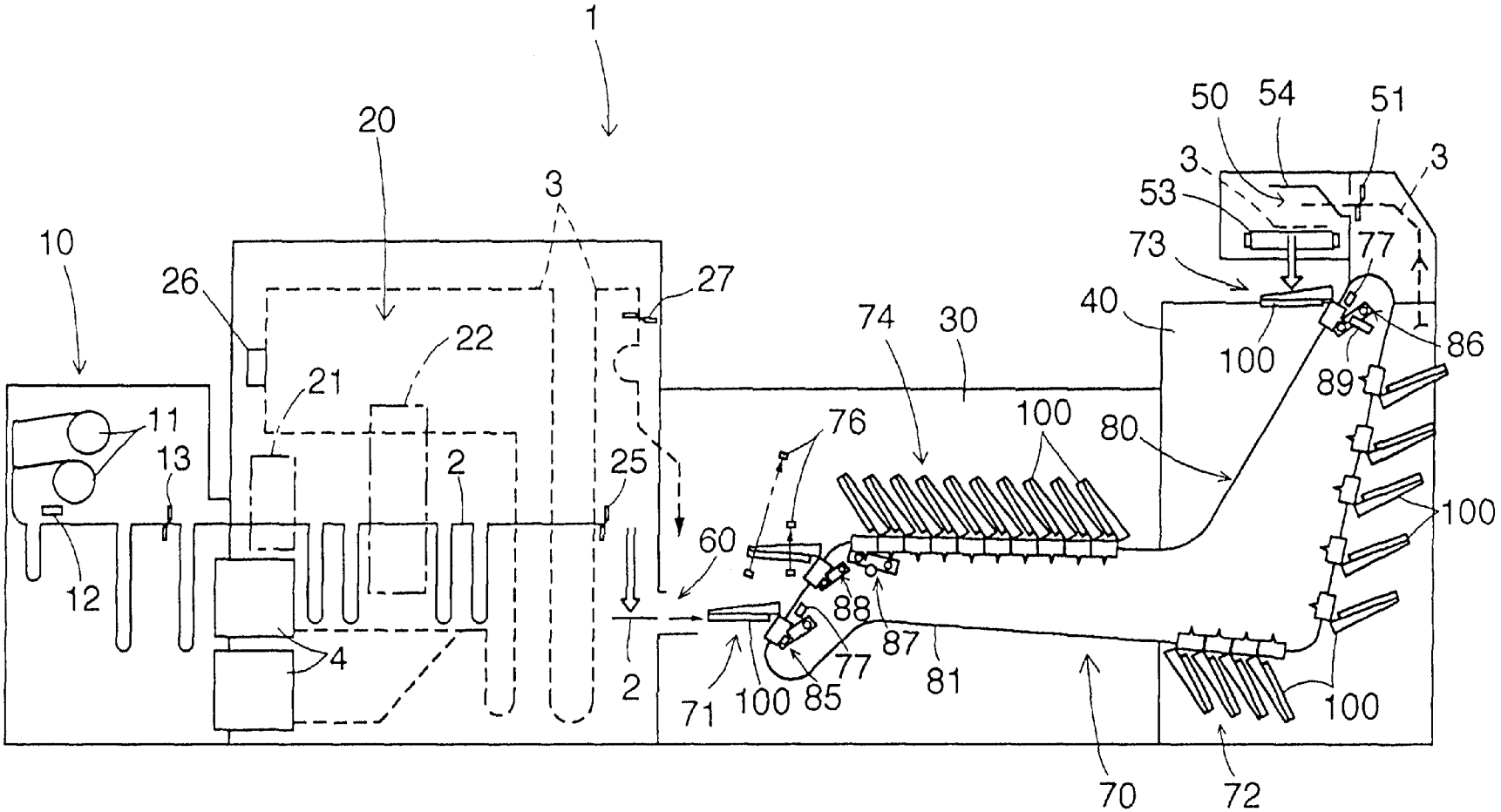
FIG. 2 is a schematic view of the photographic processing apparatus showing flows of negative films and printing paper in the apparatus of FIG. 1.

FIG. 1 shows an entire photographic processing apparatus 1 employing a photograph collating system according to this invention. FIG. 2 schematically shows transport paths of a negative film 2 (the term negative film being used herein to refer collectively to a negative film having a length of one photographic film, cut piece negatives each having several frames, and a negative film in a cartridge designed for an advanced photo system) and printing paper 3 undergoing varied processes in the photographic processing apparatus 1. This photographic processing apparatus 1 includes a negative film feeder 10, an exposing section 20 for printing images of the negative film 2 on the printing paper 3, a developing section 30 for developing the exposed printing paper 3, a drying section 40 for drying the developed printing paper 3, a print outlet 50 for cutting and discharging the dried printing paper 3 in predetermined lengths as prints, a negative film outlet 60 for cutting and discharging the negative film 2 used in the exposing section 20, with negative sheets inserted as necessary, and a conveyer mechanism 70 for collating and combining, as a finished product, the cut negative films 2 in one unit (which may be regarded as one order to facilitate understanding) received from the negative film outlet 60 and the prints in the one unit received from the print outlet 50, and transporting the finish product to a position for collection by the operator. This conveyer mechanism 70 forms a core element in the photograph collating system according to this invention.

The negative film feeder 10 may be loaded with two negative reels 11 each having up to 100 negative films 2 connected by splicing tape. A bar-code reader 12 reads bar codes on the negative films 2 drawn from either negative reel 11. A negative cutter 13 cuts the negative films 2 order by order.

Figure 3:
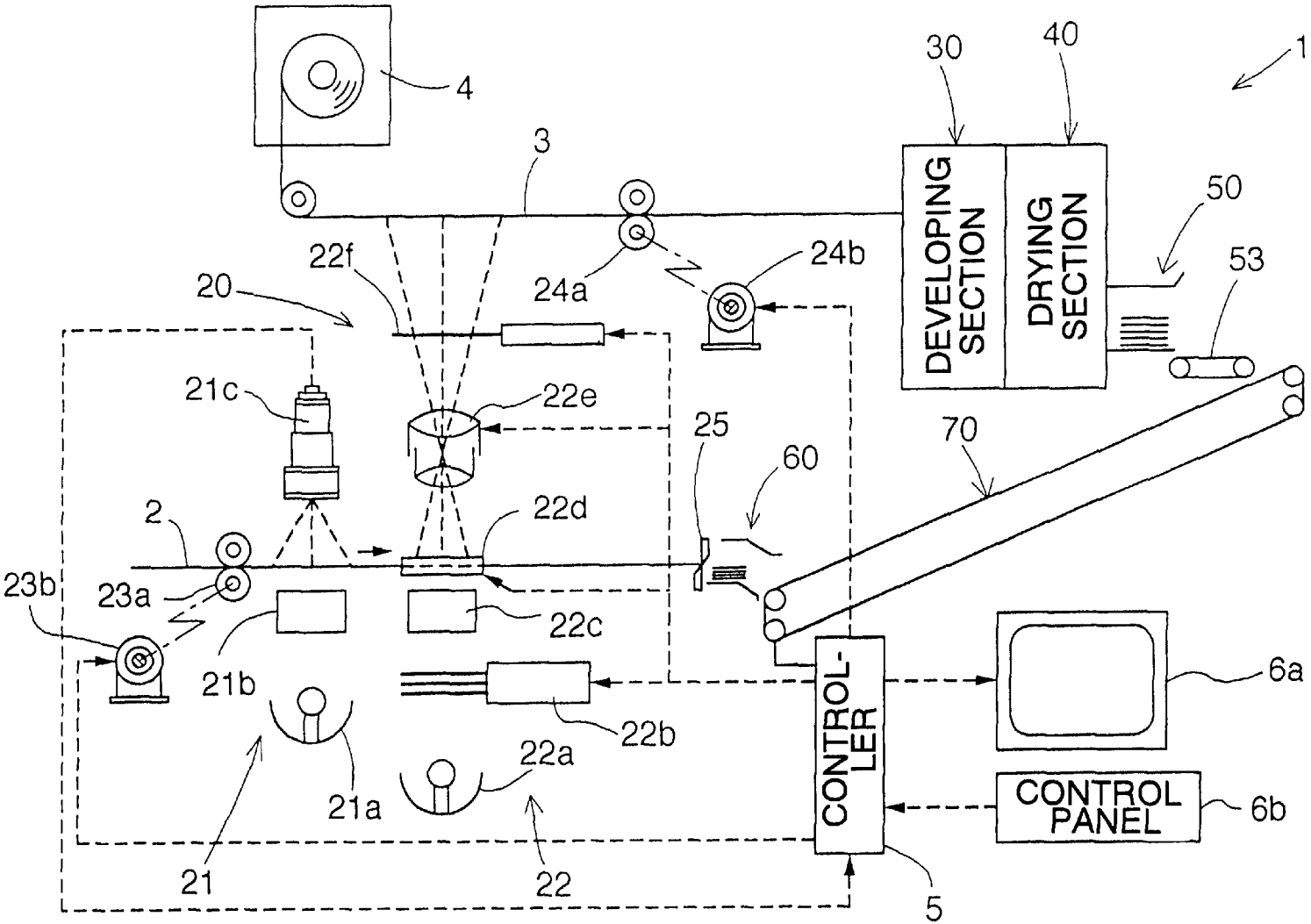
FIG. 3 is a block diagram of the photographic processing apparatus shown in FIG. 1.

As shown in FIG. 3 (in which the vertical arrangement of negative film 2 and printing paper 3 is inverted from FIG. 2), the exposing section 20 includes a film reader 21 disposed upstream with respect to a direction of film transport and having a reading light source 21*a,* a mirror tunnel 21*b* and an image pickup 21*c,* and an exposing device 22 disposed downstream with respect to the film transport direction and having an exposing light source 22*a,* a light adjustment filter 22*b,* a mirror tunnel 22*c,* a negative mask 22*d,* a printing lens 22*e* and a shutter 22*f.* Rollers 23*a* and a motor 23*b* for driving the rollers 23*a* are provided to transport the negative film 2 from the negative film feeder 10 through the exposing section 20 to the negative outlet 60.

First, the film reader 21 reads the image of each frame on the negative film 2 transported by the rollers 23*a,* and transmits image information to a controller 5 which controls the entire photographic printing apparatus. From the image information received from the film reader 21, the controller 5 derives exposing conditions for printing the images of the negative film 2 on the printing paper 3. The controller 5 controls the light adjustment filter 22*b* and shutter 22*f* based on the exposing conditions derived to expose the printing paper 3 when the corresponding frame on the negative film 2 arrives at the position of negative mask 22*d.* In addition, the controller 5 processes the image information of the negative film 2 read by the film reader 21, and causes a monitor 6*a* to display simulations of images to be printed on the printing paper 3 with the exposing conditions derived. The operator may observe the simulated images displayed on the monitor 6*a,* and correct the exposing conditions through a control panel 6*b* as necessary.

The negative film 2 emerging from the exposing section 20 is cut to a plurality of negative pieces 2 each having six or four frames by a negative cutter 25 in the negative outlet 60 disposed downstream of the exposing device 22 with respect to the film transport direction. The negative pieces 2 are delivered to the conveyer mechanism 70. Depending on specifications, the negative pieces 2 may be inserted into negative sheets by a negative inserter not shown, the negative sheets being folded before delivery to the conveyer mechanism 70. The negative film 2 designed for an advanced photo system is drawn out of the cartridge before the varied processes, and rewound into the cartridge again after the processes. This type of negative film 2 after the exposing process is delivered to the conveyer mechanism 70 as contained in the cartridge.

The developing section 30 includes a plurality of developing tanks not shown The printing paper 3, with the images of the negative film 2 printed thereon in the exposing section 20, is transported by rollers 24*a* and a motor 24*b* for driving the rollers 24*a,* through a correction print unit 26, and successively through the developing tanks in the developing section 30 to be developer. A cutter 27 is disposed upstream of the developing section 30 for cutting the printing paper 3 in an emergency, e.g. when the printing paper 3 cannot be fed from the exposing section 20 to the developing section 30 despite the presence of a loop.

The developed printing paper 3 is dried in the drying section 40 and forwarded to the print outlet 50, where the paper 3 is cut by a paper cutter 51 to become finished prints 3. The prints 3 are delivered by a transverse conveyer 53 to the conveyer mechanism 70. Numeral 54 denotes a printing paper bypass for discharging the printing paper 3 without being cut when the printing paper 3 cannot be delivered to the conveyer mechanism 70 owing to some trouble.

Figure 4:
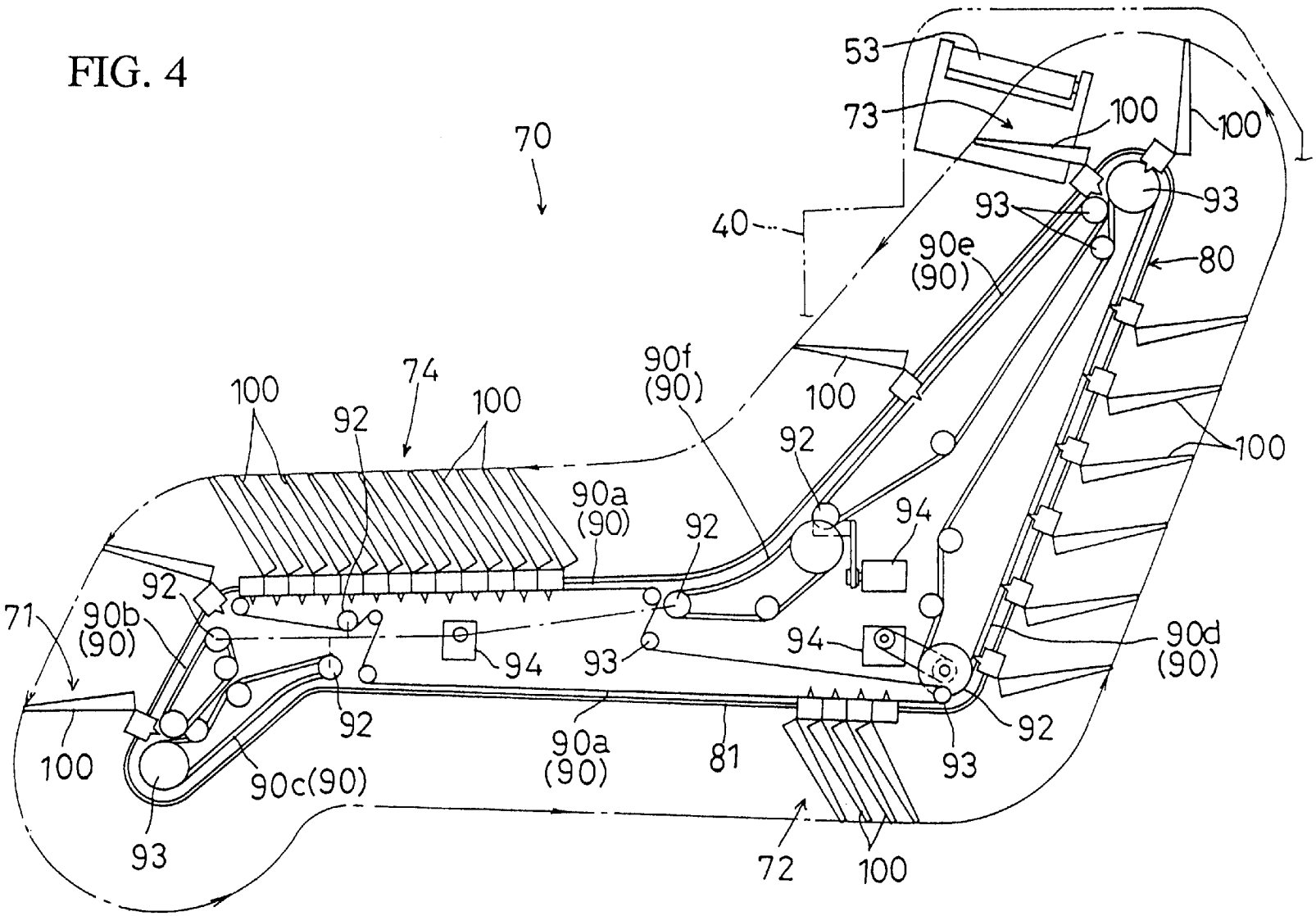
FIG. 4 is a schematic view of a conveyer mechanism forming part of the photograph collating system.
Figure 5:
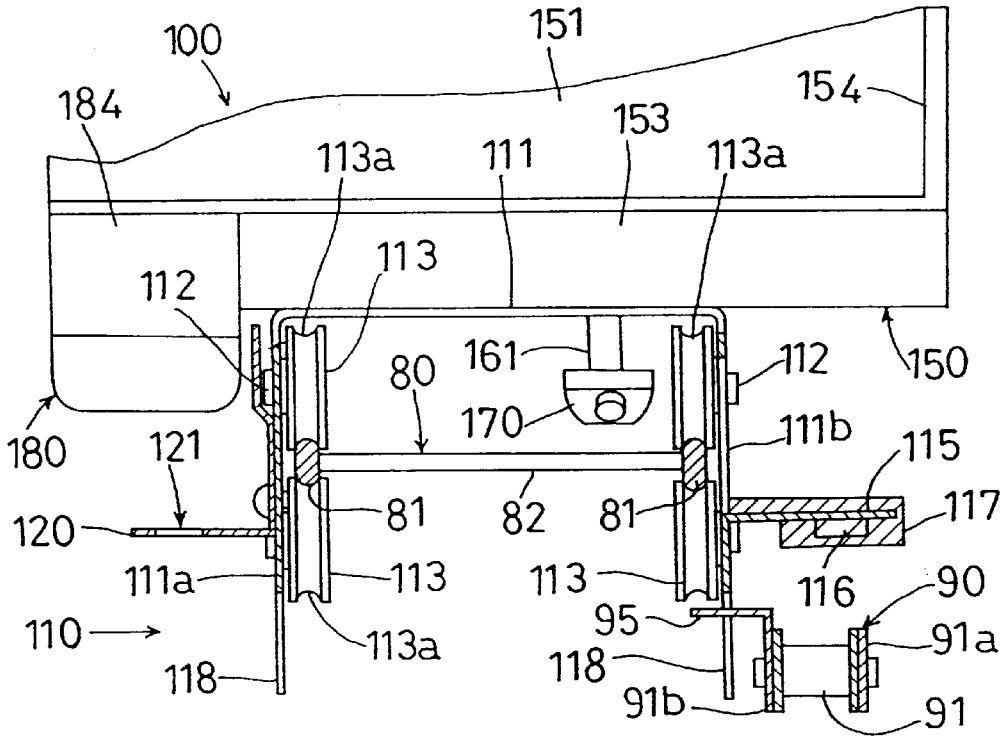
FIG. 5 is an explanatory view showing a relationship between a drive unit and a running device of a tray.

Referring to FIG. 4, the conveyer mechanism 70 is the tray conveyer type including a plurality of trays 100 driven by a drive device 90 to move along a guide circuit 80. A transport line provided by the guide circuit 80 includes a negative film intake station 71, a standby station 72, a print intake station 73 and a collating station 74. As shown in FIG. 5, the guide circuit 80 is formed of a pair of right and left rails 81 having an approximately circular section and a connector 82 interconnecting the rails 81 with a predetermined spacing therebetween. The guide circuit 80 extends along side walls of the developing section 30 and drying section 40 and between the negative film outlet 60 disposed in a lower position of the photographic processing apparatus 1 and the print outlet 50 disposed in an upper position thereof.

Figure 6:
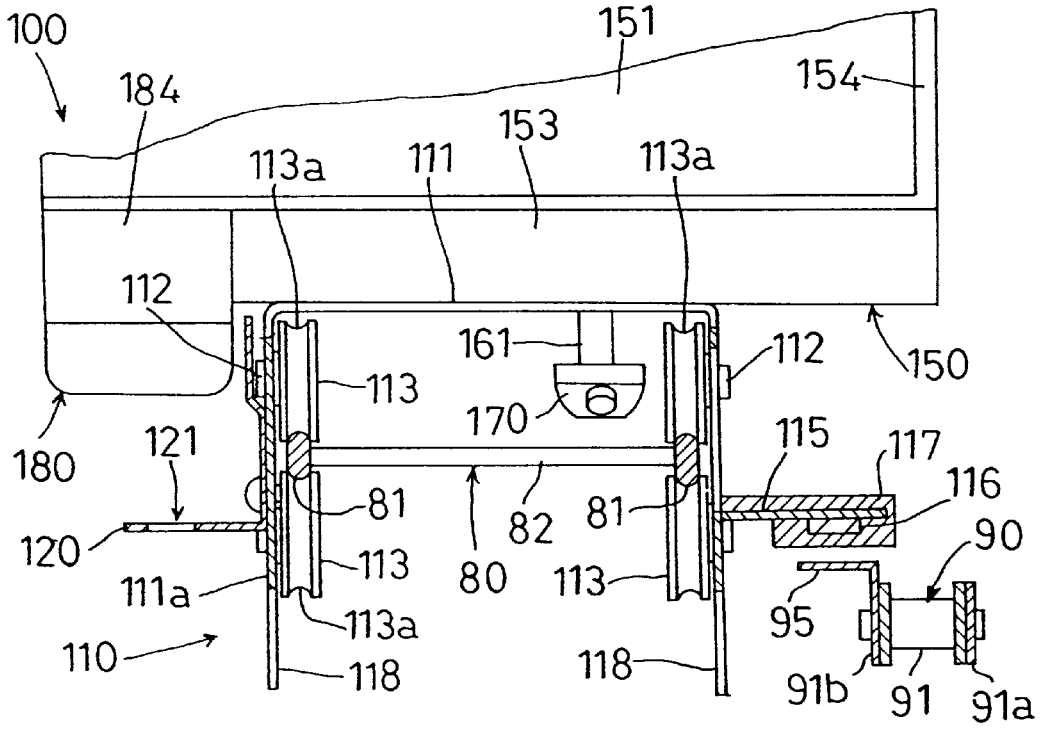
FIG. 6 is an explanatory view showing a relationship between another drive unit and the running device of the tray.
Figure 7:
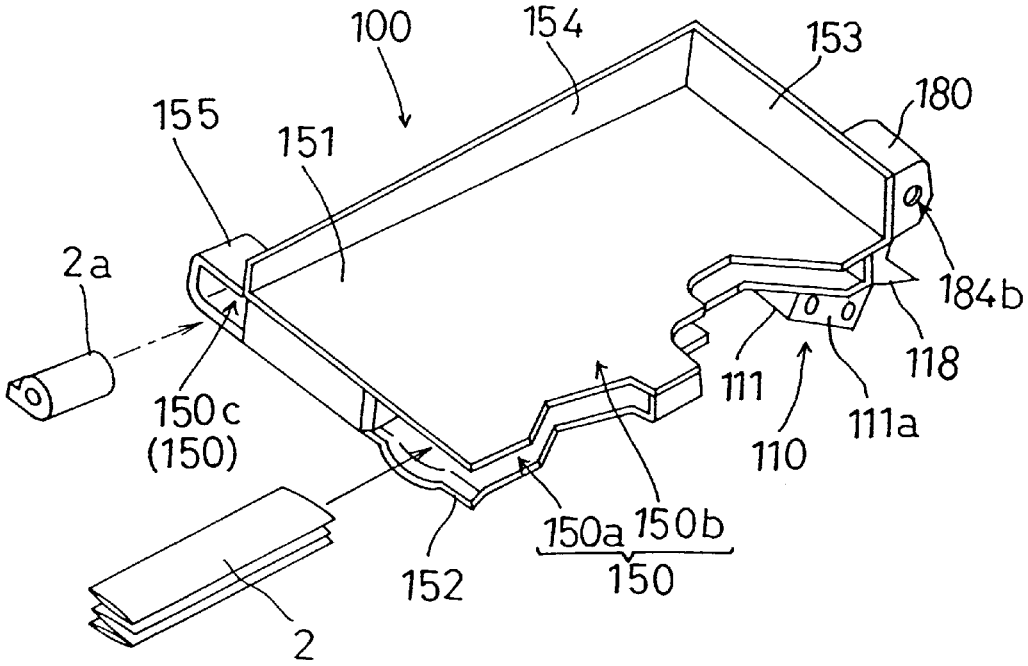
FIG. 7 is an explanatory view showing loading of negative films into a film holder.

As shown in FIGS. 5 through 7, each tray 100 includes a running device 110 for running on the rails 81, and a carrier 150 having a film holder 150*a* and a print holder 150*b.* The running device 110 has a channel-shaped running base 111, four running rollers 113 rotatably supported through axles 112 inside each of opposite side ribs 111*a* and 111*b* of the running base 111, and an angle bracket 114 (FIG. 8) for attaching the carrier 150 to the running base 111 at an angle thereto. The eight running rollers 113 of each tray 100 have running surfaces defining grooves 113*a* shaped to fit on the rails 81. The running device 110 runs steadily on the rails 81, with upper and lower front running rollers 113 and upper and lower rear running rollers 113 on the right rib 111*a* gripping the right rail 81 in two positions thereof and upper and lower front running rollers 113 and upper and lower rear running rollers 113 on the left rib 111*a* gripping the left rail 81 in two positions thereof.

At the negative film intake station 71, negative films 2 in one unit discharged from the negative film outlet 60 are transferred to the film holders 150*a* of trays 100. At the standby station 72, the trays 100 loaded with the negative films 2 can stand by to ensure timing to discharge from the print outlet 50 of prints 3 in the one unit having the images of negative films 2 loaded into the trays 100. At the print intake station 73, the prints 3 in the one unit on which the images of negative films 2 stored in the film holders 150*a* are printed are transferred from the print outlet 50 to the print holders 150*b* of trays 100. At the collating station 74, the negative films 2 and prints 3 in the one unit carried by the trays 100 are collated, collected from the trays and put into a product packet. Such collation and collection from each tray 100 are not synchronized with delivery of the trays 100 to the collating station 74. Thus, at the collating station 74, as at the standby station 72, the trays 100 may be stored on the rails 81. Emptied trays 100 are forward to the negative film intake station 71 again.

The trays 100 are transported by a drive device 90 of the chain drive type employing chains 91 as endless drive elements. As seen from FIG. 4, the drive device 90 is divided into a first to a sixth drive units 90*a*–90*f*. The first drive unit 90*a* extends between the collating station 74 and standby station 72. The second drive unit 90*b* is arranged to move emptied trays 100 to a tray stopping position in the negative intake station 72. The third drive unit 90*c* is arranged to move the trays 100 loaded with the negative films 2 to a storage line at the standby station 72 defined partly by the first drive unit 90*a*. The fourth drive unit 90*d* is arranged to move the trays 100 stored in the standby station 72 successively to a tray stopping position in the print intake station 73. As seen from FIG. 4, the fourth drive unit 90*d* moves the trays 100 up a steep slope. The fifth drive unit 90*e* moves the trays 100 additionally loaded with prints 3 down a steep slope to a portion of the first drive unit 90*a* forming the collating station 74. Since the guide circuit 80 is curved upstream of the collating station 74, the sixth drive unit 90*f* is disposed between the fifth drive unit 90*e* and the first drive unit 90*a* to move the trays 100 along the curved line. Each of the above drive units includes a chain 91, a drive sprocket 92 and direction changing sprockets 93 engaging the chain 91, and a dive motor 94 for driving the drive sprocket 92. The first, second, third and sixth drive units 90*a*, 90*b*, 90*c* and 90*f* receive power from a common drive motor 94 timed way, and therefore receive power from individual drive motors 94, respectively. Each chain 91 includes not only ordinary link plate 91*a* but pulling link plates 91*b* defining hitches 95 arranged at predetermined intervals and extending axially of the rollers. Each chain 91 moves the trays 100 by means of these hitches 95.

Two types of engagement are employed for drive transmission between the hitches 95 and the running devices 110 of the trays 100. That is, to form the storage lines, the first drive unit 90*a* produces an engagement as shown in FIG. 6. A magnet 116 is fixed by a resin 117 to a lower surface of a mounting plate 115 extending perpendicular to and outwardly of the rib 111*b* of each running device 110. A magnetism acts between the magnet 116 and each hitch 95 of the chain 91 to form an engagement between the running device 110 of each tray 100 and each hitch 95 of the chain 91, whereby the chain 91 moves the tray 100. For this purpose, at least the pulling link plates 91*b* are formed of a magnetic substance. Thus, when the tray 100 is stopped running by a force greater than the magnetism acting between the tray 100 and chain 91, the engagement between the magnet 116 and hitch 95 is broken whereby only the chain 91 moves forward, leaving the tray 100 standing still. In this way, the trays 100 are successively stored with end surfaces of the running bases 111 contacting each other. After a preceding tray moves forward, the magnet 116 of a next tray 100 magnetically engages a hitch 95 of chain 91 again. Thus, the next tray 100 begins to be moved by the chain 91. That is, the trays 100 are stored and advanced to the position for taking out the negative films 2 and prints 3 automatically and without delay.

The drive units other than the first drive unit 90*a* have only to move trays 100 and chains 91 together. As shown in FIG. 5, lugs 118 extend downward from lower ends of the ribs 111*a* and 111*b* of each running base 110 to contact the bitches 95 of chain 91. As a result, an engagement is produced to transmit drive between the running device 110 and hitches 95. The drive motors 94 are controlled by the controller 5 in a coordinated way. motors 94 are controlled by the controller 5 in a coordinated way.

At the negative film intake station 71, the trays 100 are stopped by a first stopper 85 between the second dive unit 90*b* the third drive unit 90*c* to receive negative films 2 from the negative outlet 60. Further, at the print intake station 73, the trays 100 are stopped by a second stopper 86 between the fourth drive unit 90*d* and fifth drive unit 90*e* to receive prints 3 from the print outlet 50. The first stopper 85 and second stopper 86 have the same construction. The construction of the first stopper shown in FIG. 8 will be described here.

Figure 8:
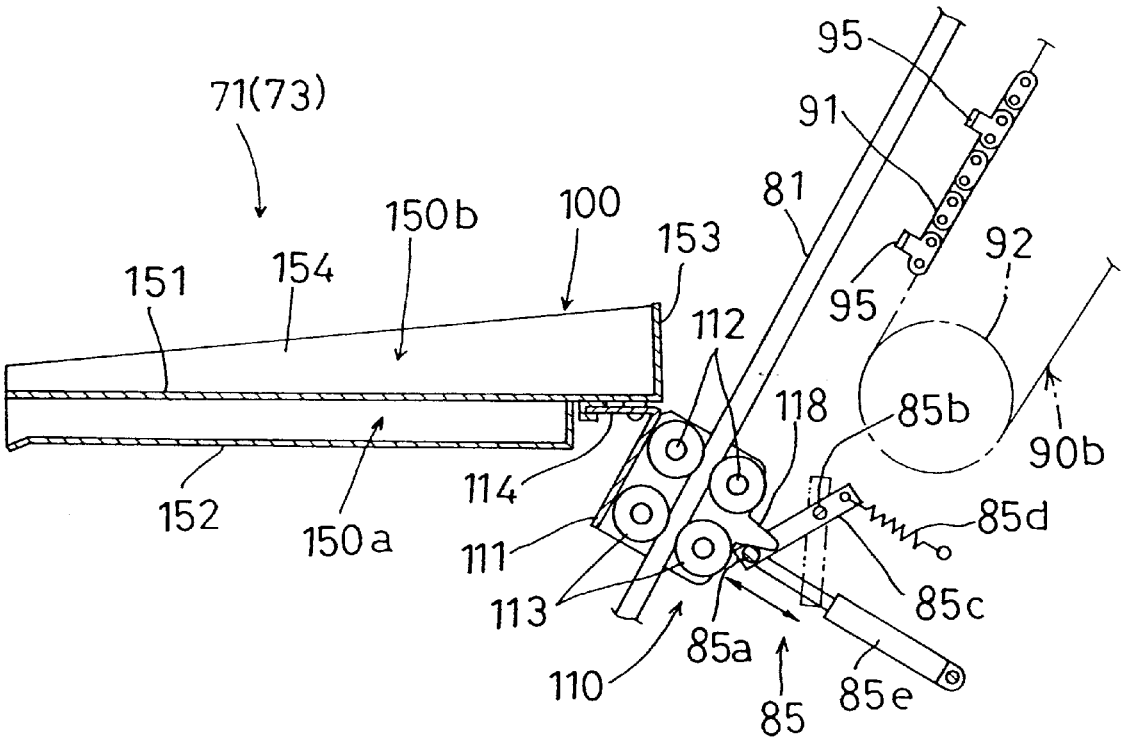
FIG. 8 is a schematic view of a first stopper.

The first stopper 85 includes a swing arm 85*c* pivotable about an axis 85*b*, an engaging pin 85*a* disposed at one end of the swing arm 85*c* for engaging, upon swing of the swing arm 85*c*, one of the lugs 118 on the running base 111 of each tray 100, a spring 85*d* engaged with the other end of the swing arm 85*c* to bias the swing arm 85*c* clockwise about the axis 85*b* in FIG. 8, and a linear acting solenoid 85*e* connected to the swing arm 85*c* adjacent the engaging pin 85*a*. When energized, the linear solenoid 85*e* swings the swing arm 85*c* counterclockwise about the axis 85*b* in FIG. 8. When the linear solenoid 85*e* is de-energized, the engaging pin 85*a* enters a moving track of the lugs 118 of trays 100. Thus, the first stopper 85 stops the tray 100 released from the hitch 95 of the second drive unit 90*b* and sliding down the sloping rails 81. When the linear solenoid 85*e* is energized, the engaging pin 85*a* is retracted from the moving track of the lugs 118 of trays 100 to permit passage of the trays 100. The positional relationship between the second stopper 86 and the fourth drive unit 90*d*, and downward sloping of the rails 81, are similar to the case of the first stopper 85. The second stopper 86 can similarly control stopping and passage of the trays 100.

Figure 9:
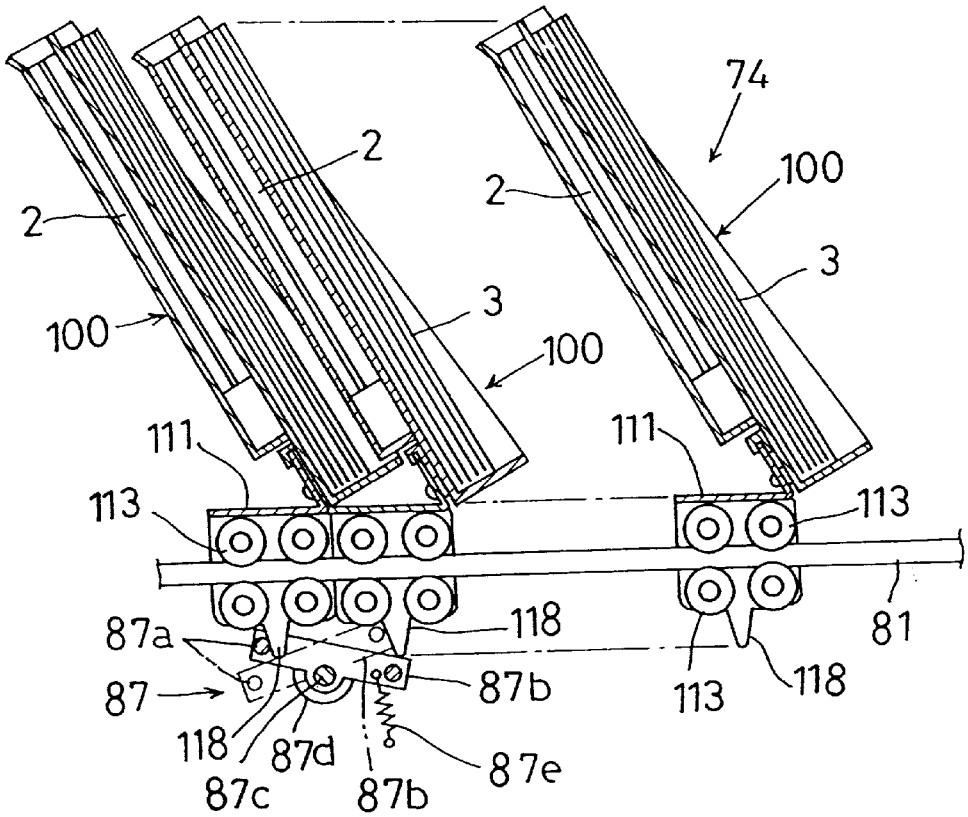
FIG. 9 is a schematic view of a third stopper.

The collating station 74 has a third stopper 87 for stopping a leading end of trays 100 stored. As shown in FIG. 9, the third stopper 87 includes a swing arm 87*b* which makes seesaw movement about a rotary shaft 87*c*, a pair of engaging pins 87*a* disposed at opposite ends of the swing arm 87*b* for selectively engaging the lugs 118 of trays 100 upon swing of the swing arm 87*b*, a rotary solenoid 87*d* connected to the rotary shaft 87*c* to swing the swing arm 87*b*, and a spring 87*e* engaged with one end of the swing arm 87*b* to bias the swing arm 87*b* clockwise in FIG. 9. With the third stopper 87 having the above construction, when the rotary solenoid 87*d* is de-energized, the spring 87*e* places the swing arm 87*b* in a position shown in solid lines in FIG. 9, to stop the leading tray 100. The other trays 100 following the leading tray 100 are moved along the rails 81 by magnetism until each contacts a preceding tray 100. Upon contact with the preceding tray 100, the movement by magnetism becomes impossible, and thus the trays 100 are successively stored close to one another. When the rotary solenoid 87*d* is energized, the swing arm 87*b* is moved against the biasing force of spring 87*e* to a position shown in two-dot-and-dash lines in FIG. 9, to stop the next tray 100. The first drive unit 90*a*, by magnetism, starts moving the leading tray 100 now freed and, with the aid of the downward slope, is passed on to the second drive unit 90*b*. When, in this state, the rotary solenoid 87*d* is de-energized, the swing arm 87*b* returns to the position shown in the solid lines in FIG. 9, to stop the new leading tray 100 having been moved slightly by the first drive unit 90*a*. The tray 100 released from the first drive unit 90*a* moves toward the second drive unit 90*b* with the aid of the downward slope, and is stopped by a fourth stopper 88 disposed between the first drive unit 90*a* and second drive unit 90*b*.

Figure 10:
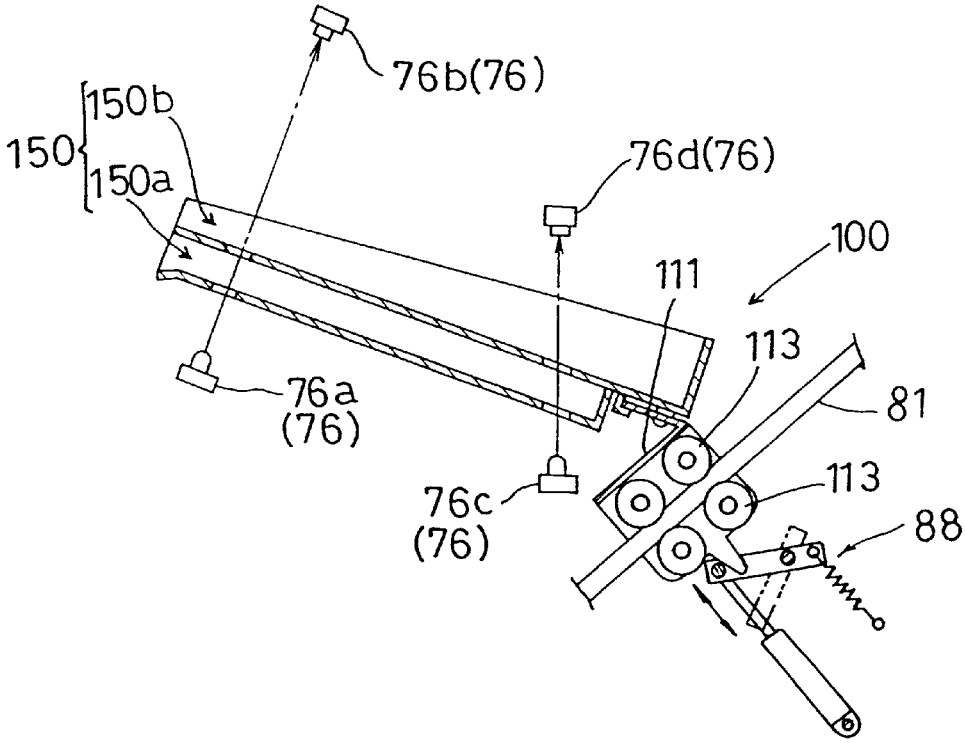
FIG. 10 is a schematic view of an optical sensor.

The fourth stopper 88 is operable to time forwarding of each tray 100 to the negative film intake station 71. The fourth stopper 88 is controlled to advance a new tray 100 simultaneously with departure of a preceding tray 100 from the negative film intake station 71. That is, the third stopper 87 and fourth stopper 88 advance one stored tray 100 after another to the negative film intake station 71, while at the same time the trays 100 are successively advanced along the storage line of the collating station 74. As shown in FIG. 10, the fourth stopper 88 has substantially the same construction as the first stopper 85 and second stopper 86, and will not be described further.

As shown in FIG. 10, an optical sensor 76 is provided in a position where each tray 100 is stopped by the fourth stopper 88, for detecting negative films 2 and prints 3 stored in the film holder 150*a* and print holder 150*b* of tray 100, respectively. The optical sensor 76 includes an LED 76*a* and a light receiving element 76*b* for detecting negative films 2, and an LED 76*c* and a light receiving element 76*d* for detecting prints 3. The carrier 150 defines bores (not shown) for allowing passage of light emitted from the LED 76*a* and LED 76*c*. Detection signals of the optical sensor 76 are inputted to the controller 5 which determines whether the tray 100 stopped by the fourth stopper 88 is empty or not. The operations of the first stopper 85, second stopper 86, third stopper 87 and fourth stopper 88 are controlled by the controller 5.

Figure 11:
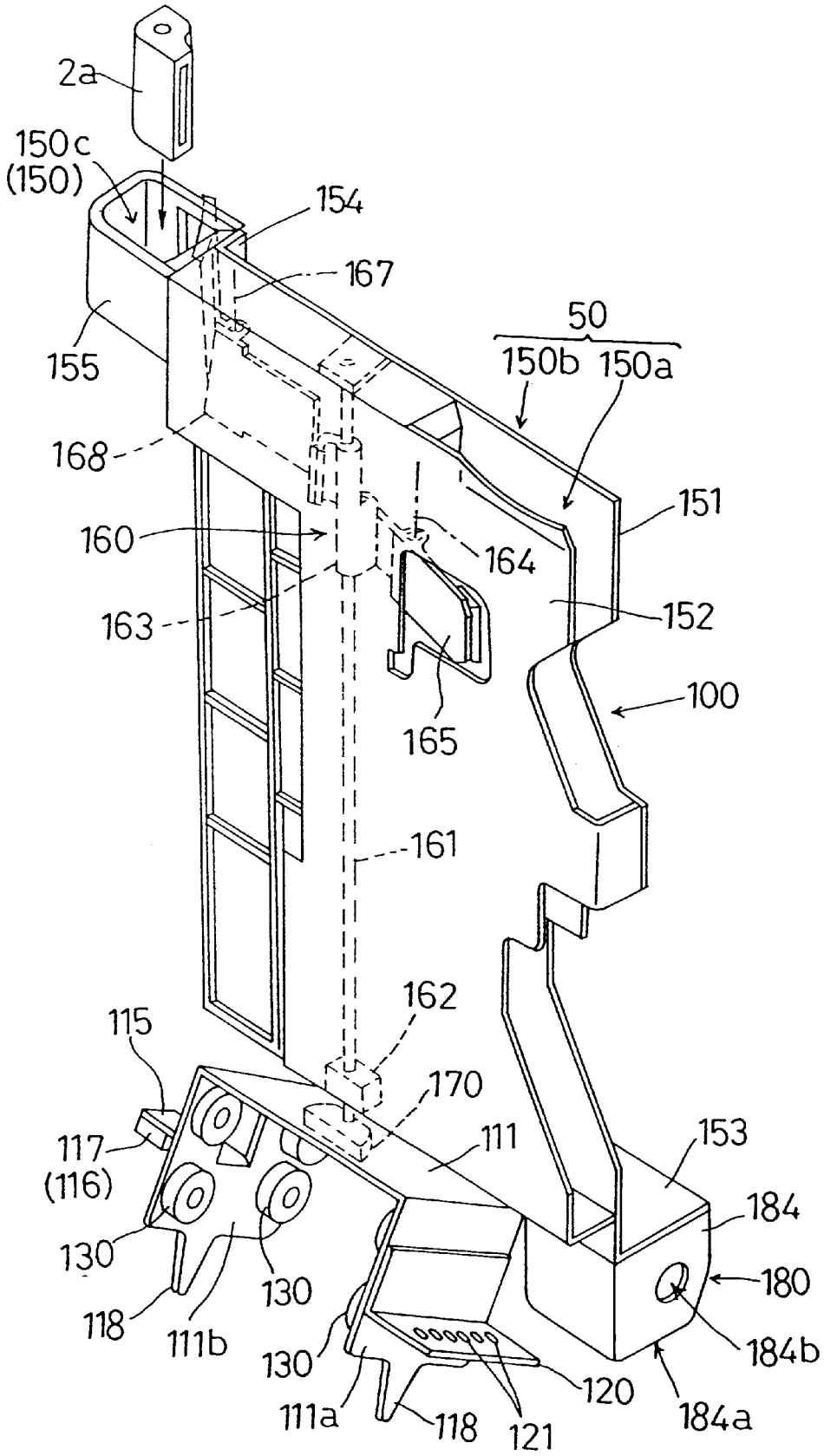
FIG. 11 is a perspective view of a tray.
Figure 12:
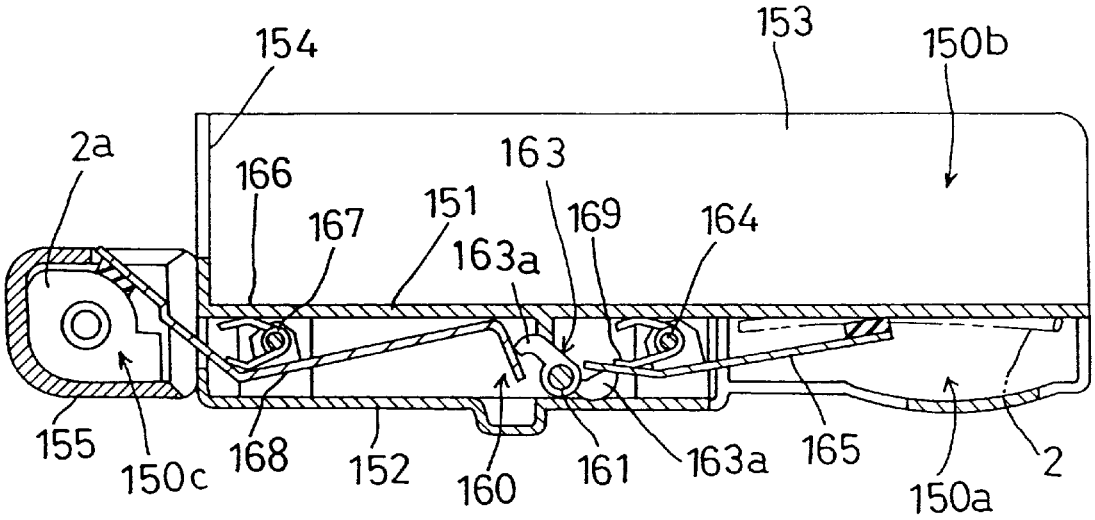
FIG. 12 is a sectional view of a pressing/retaining mechanism of a tray.
Figure 13:
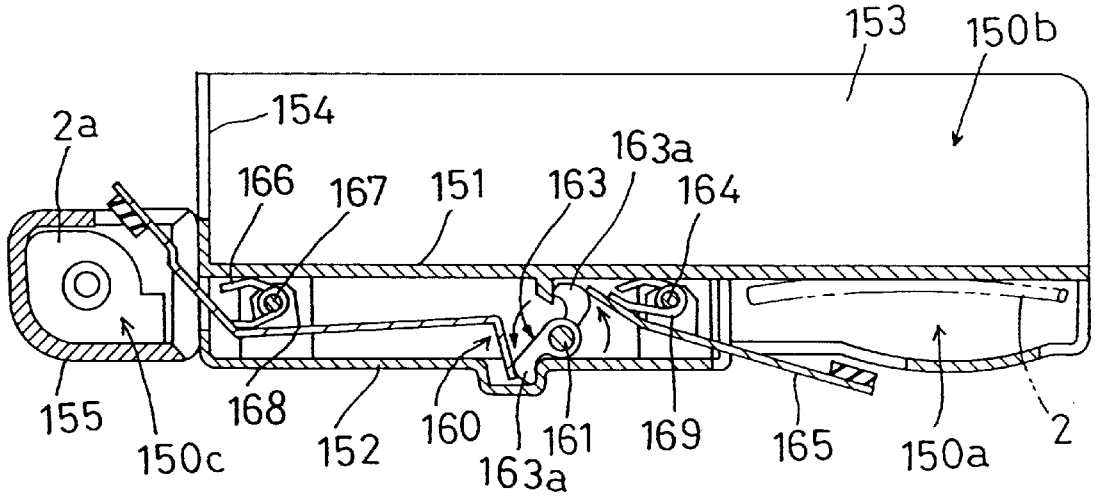
FIG. 13 is a sectional view of the pressing/retaining mechanism of the tray.

The construction of the carrier 150 of tray 100 will be described with reference to FIG. 11. The carrier 150 is in the form of a box having, as main components thereof a top plate 151, a bottom plate 152, a first side plate 153 and a second side plate 154. The print holder 150*b* is formed on the top plate 151. To retain the prints 3 as stacked on the top plate 151, the first side plate 153 and second side plate 154 project from the top plate 151 to enclose the prints 3 from two directions. The print holder 150*b* is open in the remaining two directions to facilitate loading and unloading of the prints 3. The film holder 150*a* is in the form of a pocket between the top plate 151 and bottom plate 152 for storing negative films 2, i.e. bare piece negatives or piece negatives inserted into negative sheets. In addition, a cartridge holder 150*c* is provided in the form of a box 155 attached to an outer surface of the second side plate 154 and opposed to the film holder 150*a*, for storing a cartridge 2*a* containing a roll of negative film 2 designed for an advanced photo system.

Figure 14:
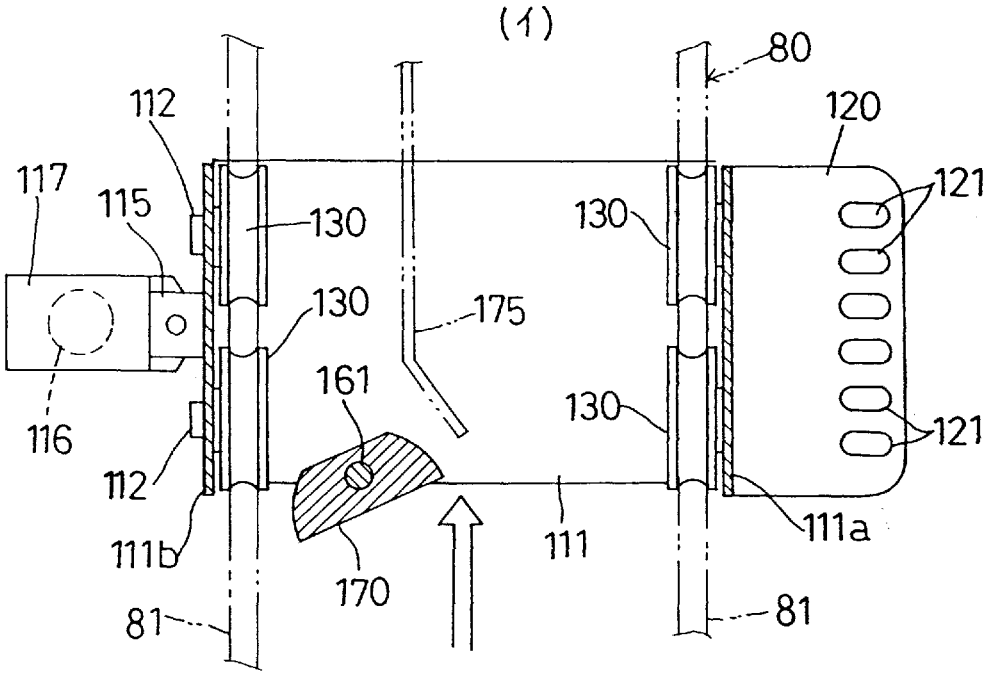
FIGS. 14(*a*) and (*b*) are explanatory views showing operation of a control knob.
Figure 14:
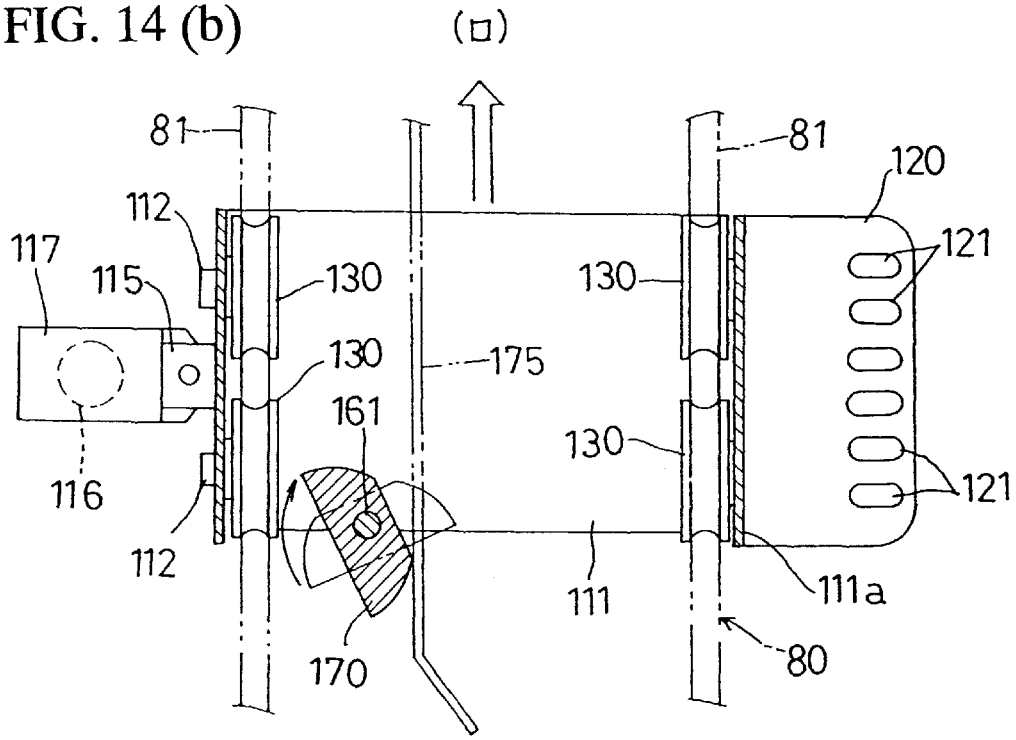

As seen from FIG. 4, the trays 100 are suspended upside down during their movement from the negative film intake station 71 to the standby station 72. To prevent the articles falling from the film holder 150*a* and cartridge holder 150*c*, the tray 100 includes a pressing/retaining mechanism 160. As illustrated in FIGS. 11 through 14, the pressing/retaining mechanism 160 includes a shaft 161 rotatably supported by the bottom plate 152 through a plurality of bearing brackets 162, a lug sleeve 163 fixed to the rotatable shaft 161, a first presser plate 165 pivotable in seesaw motion about a shaft 164 fixed to the top plate 151 to press one end thereof upon the negative films stored in the film holder 150*a*, and a second presser plate 168 pivotable in seesaw motion about a shaft 167 fixed to the top plate 151 to press one end thereof upon the cartridge stored in the cartridge holder 150*c*. The first presser plate 165 and second presser plate 168 are pivotable in opening directions by a turning force of the lug sleeve 163 transmitted through contact with lugs 163*a* on the lug sleeve 163. The presser plates 165 and 168 are pivotable in pressing directions under spring load, and for this purpose helical springs 166 and 169 are provided therefor, respectively. For turning the rotatable shaft 161, a rounded control knob 170 is fixed to the end of the shaft 161 opposed to the running base 111. As shown in FIG. 14, the control knob 170 is operable through contact with a knob guide rail 175, to turn the rotatable shaft 161. As a result, the lug sleeve 163 is displaced from the position shown in FIG. 12 to the position shown in FIG. 13. The lugs 163*a* thereby push up the first and second presser plates 165 and 168 against the forces of the helical springs 166 and 169, to open the first and second presser plates 165 to allow negative films 2 to be loaded into the film holder 150*a* and the cartridge 2*a* into the cartridge holder 150*c*. Upon termination of the contact between the knob guide rail 175 and control knob 170, the first and second presser plates 165 and 168 assume positions to press the articles stored. Therefore, the knob guide rail 175 is disposed in a region of the tray 100 where the negative films 2 are moved in and out.

Figure 15:
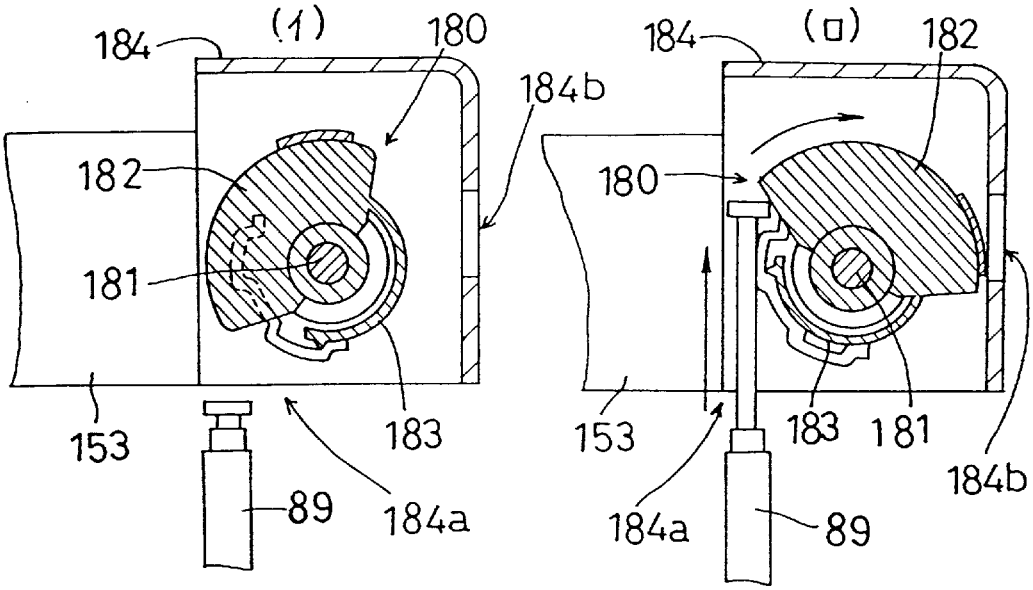
FIG. 15 is a schematic view of a collating mark display.

The tray 100 has a collating mark display 180 attached to the first side plate 153 next to a bracket 114 As shown in FIG. 15, the collating mark display 180 includes a drum 182 rotatable about an axis 181, an elastic element 183 elastically supporting the drum 182, and a housing 184 accommodating the drum 182. The housing 184 defines an opening 184*a* for receiving an external force to move the drum 182, and a display bore 184*b*. The drum 182 has a part of a peripheral wall thereof painted red. When the drum 182 rotates to a first position, the red is seen through the display bore 184*b*. When the drum 182 rotates to a second position, a ground color, e.g. white, is seen through the display bore 184*b*. The negative films 2 and prints 3 in one unit placed on the same tray 100 may not be in perfect agreement owing to some trouble occurring during the processing of the negative films 2 and printing paper 3 in the photographic processing apparatus 1. Upon confirmation of the disagreement, the controller 5 causes a mark displaying solenoid 88 disposed at the print intake station 73 to rotate the drum 182 from the second position to the first position. This action notifies the operator that the negative films 2 and prints 3 on this tray are in disagreement. The drum 182 in the first position is returned to the second position at the collating station 74.

Each tray 100 further includes an ID plate 120 attached to the running stand 111 and indicating an ID code of the tray 100. An ID sensor 77 disposed in a predetermined position of the guide circuit 80 reads perforations 121 in the ID plate 120, generates a 6-bit code, and outputs it to the controller 5. In this way, the controller 5 can keep track of which tray stores which negative films 2 and prints 3.

Figure 16:
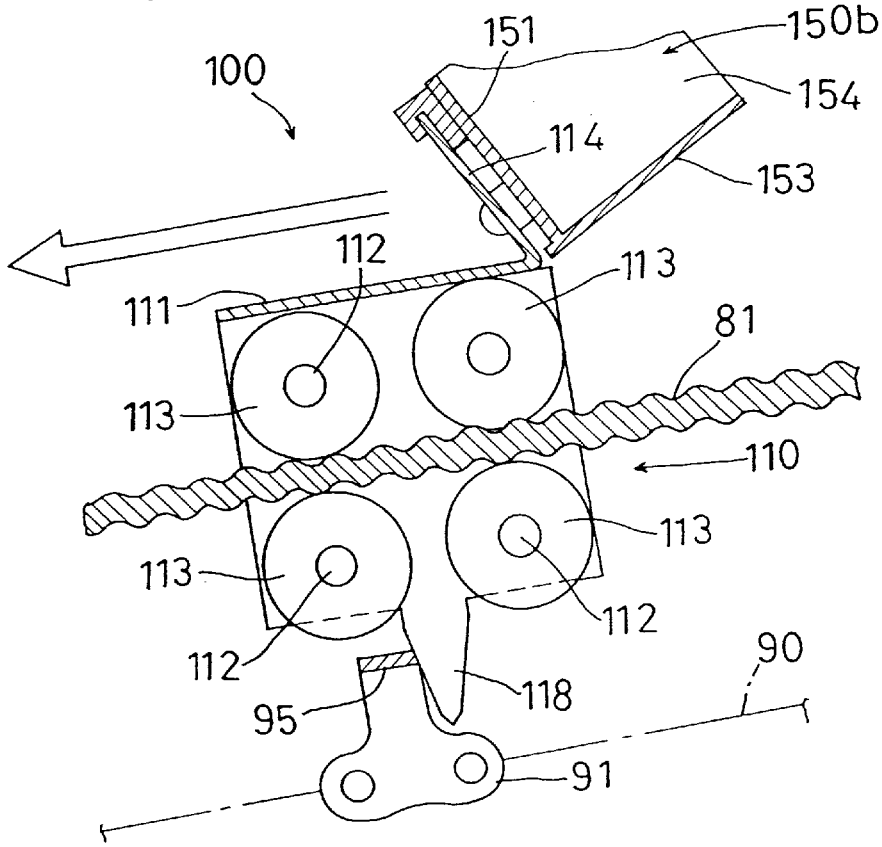
FIG. 16 is a schematic view of a rail for applying vibration.

In this embodiment, the rails 81 extending from the print intake station 73 to the collating station 74 define fine undulations as shown in FIG. 16. The carriage 150 vibrates as the running rollers 113 run on the undulations. As a result, the puts 3 stacked in a disorderly manner on the top plate 151 shift to the first side plate 153 and second side plate 154 to be in position. To align the prints 3 effectively with the vibration, the top plate 151 may be slightly inclined toward the corner of the first side plate 153 and second side plate 154. Vibration may be applied to the carrier 150 by other methods. For example, the rails 81 may cut at predetermined intervals to form small gaps. The running base 110 and carrier 150 may be connected through a flexion mechanism, with vibration applied externally from an undulating guide rail, a solenoid or the like. For applying vibration throughout the running track, the running rollers 113 may be eccentric rollers or may have rugged running surfaces.

Next, an operation of the above conveyer mechanism 70 to transport the trays 100 will be described.

In the negative film intake station 71, negative films 2 inserted in negative sheet folded, bare negative films 2, or negative films 2 in cartridges for advanced photo systems, delivered from the negative outlet 60 are automatically deposited unit by unit by a feeder not shown, in the film holders 150*a* of trays 100 stopped by the first stopper 85. The trays 100 released by the first stopper 85 in the negative film intake station 71 descend by gravity, and then run along an upward slope in engagement with the hitches 95 of the third drive unit 90*c*. The trays 100 are passed on to the first drive unit 90*a* forming the standby station 72, and are successively stored.

The leading tray 100 stored at the standby station 72 is engaged by a hitch 95 of the chain 91 of the fourth drive unit 90*d* in intermittent operation, to move up the steep slope in stages corresponding to the intervals between the hitches 95. The fourth drive unit 90*d* transports the trays 100 in stages corresponding to the intervals between the hitches 95 in interlocked relationship to the release of trays 100 by the second stopper 86 at the print intake station 73. Thus, when each tray 100 stopping at the print intake station 73 receives prints 3 in one unit from the transverse conveyer 53 and is moved down the slope by the fifth drive unit 90*e*, the next tray 100 is forwarded to the print intake position and stopped by the second stopper 86.

As long as this photographic processing apparatus 1 operates normally, and unless the number of prints in one order exceeds a predetermined amount, negative films 2 are deposited in the trays 100 unit by unit in the order of exposure in the exposing section 20. no tray 100 empty of negative films 2 receives prints 3. By receiving prints from the transverse conveyer 53 in the order of exposure, the film holder 150*a* of each tray 100 stores the prints 3 of the images of negative films 2 stored in the print holder 150*b*. When the number of prints in an order exceeds a predetermined amount, a further tray 100 is allocated to the excess prints. Apart from such exceptional cases, some trouble may result in a loss of certain of the negative films 2 and prints 3 stored in a tray 100 having a predetermined ID. This is recognized by the controller 5 as a disagreement. Then, the mark displaying solenoid 88 disposed at the print intake station 73 operates to rotate the drum 182 of collating mark display 180 to the first position to set the red indicative of the disagreement to the display bore 184*b*. The second stopper 86 releases the trays 100 having received from the transverse conveyer 53 the prints 3 to be combined with the negative films 2 in one unit. The tray 100 descends a little by gravity into engagement with a hitch 95 of the fifth drive unit 90*e*, and moves downward with movement of the chain 91. The fifth drive unit 90*e* is switchable between intermittent drive for transporting each tray 100 in stages corresponding to the intervals between the hitches 95 in interlocked relationship to the operation of the second stopper 86 according, for example, to the number of trays 100 stored at the collating station 74, and normal drive for transporting the trays 100 regardless of a state of the second stopper 86. The trays 100 driven downward by the fifth drive unit 90*e* enter the storage line of collating station 74 to be passed on to the sixth drive unit 90*f* once.

The tray 100 having entered the storage line of collating station 74 are stopped in order following the tray 100 stopped by the third stopper 87, to wait for the operator to collect negative films 2 and prints 3 from the trays 100 as finished products. The operator undertakes a predetermined recovery operation for a tray 100 displaying the red disagreement mark. In any case, the trays 100 having the negative films 2 and prints 3 removed therefrom by the operator are forwarded to the fourth stopper 88. This is done by the third stopper 87 operating in interlocked relationship to the second drive unit 90*b* transporting the trays 100 from the fourth stopper 88 to negative film intake station 71. In response to this operation, the first drive unit 90*a* advances the trays 100 one by one on the storage line.

The second drive device 90*b* transports each tray 100 released by the fourth stopper 88 to the negative film intake station 71 upon completion of loading of negative films 2 into the film holder 150*a* of tray 100 maintained in the stop position by the first stopper 85. That is, when the first stopper 85 releases the tray 100 loaded with negative films 2, the fourth stopper 88 releases the next tray 100 provided that the completion of removal of negative films 2 and prints 3 is detected by the optical sensor 76 disposed in the area of the fourth stopper 88. The empty tray 100 is fed to the negative film intake station 71. In response thereto, the third stopper 87 also releases a tray 100, whereby the tray 100 is forwarded to the fourth stopper 88.

As described above, individual ID codes are allocated to the respective trays 100 of conveyer mechanism 70. While moving through the stations, the trays 100 are successively loaded with negative films 2 and prints 3 to enable the automatic collating operation. The collating mark display 180 displays the disagreement mark when the tray 100 is loaded with incorrect negative films 2 and/or prints 3.

Figure 17:
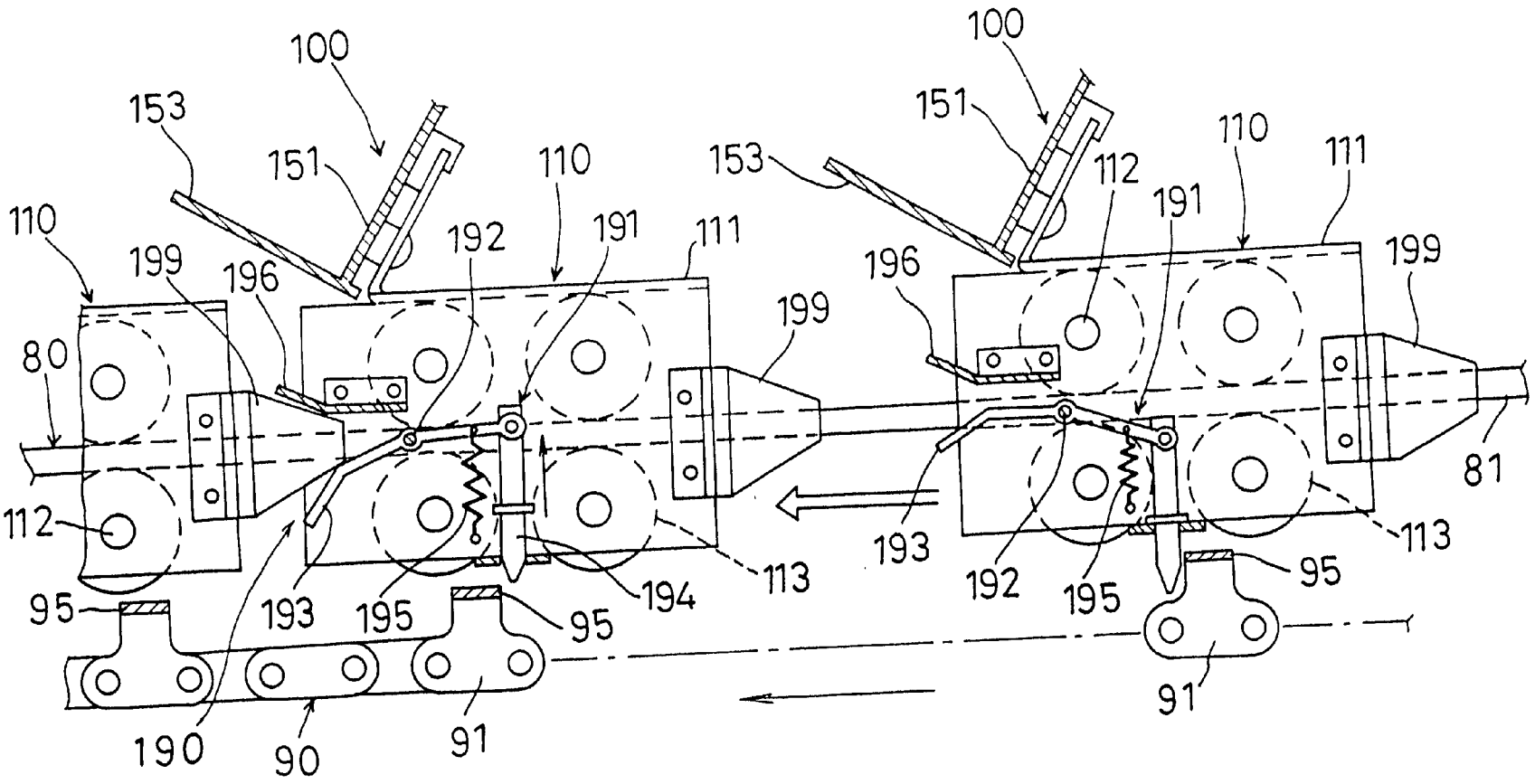
FIG. 17 is a schematic view of a modified engagement between a first drive unit and trays.

In the foregoing embodiment, the engagement between the first drive unit 90*a* forming the storage line of trays 100 and each tray 100 is achieved by magnetic coupling between the magnet 116 disposed on the tray 100 and the hitch 95 disposed on the chain 91 of the first drive unit 90*a*. It is also possible to employ a mechanical engagement based on a link mechanism. A typical example is shown in FIG. 17. In this example, each tray 100 includes a coupling device 190 having a link mechanism 191 disposed on a front surface of running base 110, and a link control element 199 disposed on a rear surface of running base 110. The link mechanism 191 includes a swing arm 193 swingable on a pivot pin 192, a hitch rod 194 connected to a rear end of swing arm 193, and a guide 196 extending approximately horizontally above the swing arm 193. The swing arm 193 is maintained in an approximately horizontal position by the biasing force of a spring 195. In this state, the hitch rod 194 projects from the bottom of running base 110 toward the chain 91. When one of the hitches 95 on the chain 91 engages the hitch rod 194, the tray 100 is moved by the chain 91. When this tray 100 contacts the preceding tray 100 on the storage line, the link control element 199 of the preceding tray 100 enters between the swing arm 193 and guide 196 of the following tray 100. As a result, the swing arm 193 swings counterclockwise in FIG. 17, against the biasing force of spring 195, to pull up the distal end of hitch rod 194 out of engagement with the hitch 95 on the chain 91. Then, the drive is no longer transmitted from the chain 91 to the tray 100. This tray 100 stops behind the preceding tray 100 standing still. When the preceding tray 100 is gone, the swing arm 193 returns to the original position, and the hitch rod 194 is engaged by a hitch 95 on the chain 91, whereby the tray 100 begins to move. To stop the tray 100 employing the above link mechanism 191, it is necessary to modify the first to third stoppers 85, 86 and 87 to operate swing elements shaped like the control element 199.

What is claimed is:

1. A photographic collating system having a negative film outlet for discharging negative films used to print images on a printing paper in an exposing section, and a print outlet for cutting the printing paper printed and developed to predetermined lengths, and discharging the cut printing paper as prints, the negative film discharged and the prints discharged and having the images of the negative films being combined and collated, said system comprising:

a negative film intake station for receiving said negative films from said negative film outlet;

a print intake station for receiving said prints from said print outlet;

a collating station for collating said negative films and said prints; and a tray-conveyor mechanism extending through said negative film intake station said print intake station and said collating stations said tray-conveyor mechanism comprising:

trays for loading said negative films at said negative film intake station and said prints at said print intake station, wherein said trays thereafter stop at said collating station for collating said negative films and said prints;

a guide circuit defining a transport passage of said trays;

tray-drive means divided into a plurality of drive units along said guide circuit, said tray-drive means including a first drive unit in magnetic engagement with said trays; and a stopper unit for stopping each of said trays in a predetermined position thereby forming a storage line for successively storing said trays, with one of said trays stopped by said stopper unit being in a foremost position.

2. A photograph collating system as defined in claim 1, wherein said drive means includes a first drive unit for moving said trays to said collating station, a second drive unit for moving said trays to said negative film intake station, and a third drive unit for moving said trays to said print intake station.

3. A photograph collating system as defined in claim 2, further comprising a standby station for forming a further storage line between said negative film intake station and said print intake station.

4. A photograph collating system as defined in claim 4, wherein said first drive unit includes an endless drive element extending to said standby station to form said further storage line of said standby station.

5. A photograph collating system as defined in claim 1, wherein each of said trays includes a film holder for storing said negative films, and a print holder for storing said prints, said prints having the images of said negative films stored in said film holder being stored in said print holder of the same tray.

6. A photograph collating system as defined in claim 1, wherein each of said trays defines an inclined print holding surface, said trays being forcibly vibrated during transport from said print intake station said collating station.

7. A photograph collating system as defined in claim 6, wherein said guide circuit includes an undulating portion for forcibly vibrating said trays.

8. A photographic collating system having a negative film outlet for discharging negative films used to print images on a printing paper in an exposing section, and a print outlet for cutting the printing paper printed and developed to predetermined lengths, and discharging the cut printing paper as prints, the negative film discharged and the prints discharged and having the images of the negative film being combined and collated, said system comprising:

a negative film intake station for receiving said negative films from said negative film outlet;

a print intake station for receiving said prints from said print outlet;

a collating station for collating said negative films and said prints; and a conveyor mechanism extending through said negative film intake station, said pint intake station and said collating station, said conveyor mechanism comprising trays for loading said negative films at said negative film intake station and said prints at said print intake station, wherein said trays thereafter stop at said collating station for collating said negative films and said prints;

a guide circuit defining a transport passage of said trays;

tray-drive means divided into a plurality of drive units along said guide circuit, said tray-drive means including a first drive unit in engagement with said trays by means of a link mechanism; and a stopper unit for stopping each of said trays in a predetermined position thereby forming a storage line for successively storing said trays, through contact between a preceding one of said trays stopped by said stopper unit and a following one of this tray.

* * * * *

UNITED STATES PATENT AND TRADEMARK OFFICE

CERTIFICATE OF CORRECTION

PATENT NO. : 5, 901, 949

DATED : May 11, 1999

INVENTOR(S) : Takayoshi, et al.

It is certified that error appears in the above-identified patent and that said Letters Patent is hereby corrected as shown below:

In column 1, line 63, change "punting" to - - printing - -.
In column 5, line 63, change "shown" to --Shown--.
In column 6, line 1, change "developer" to - - developed - -.
In column 7, line 60, change "bitches" to - - hitches - -.
In column 10, line 12, change "114 As" to - - 114. As - -.
In column 10, line 45, change "puts" to - - prints - -.
In column 13, line 4, change "station said" to - - station, said - -.
In column 13, line 5, change "station said" to - - station, said - -.
In column 14, line 23, change "pint" to - -print - -.

Signed and Sealed this

Fifth Day of September, 2000

*Attest:*

*Attesting Officer*

Q. TODD DICKINSON

*Director of Patents and Trademarks*